United States Patent [19]

Morton

[11] Patent Number: 5,003,747

[45] Date of Patent: Apr. 2, 1991

[54] WINDOW ASSEMBLY OF EXTRUDED PLASTICS MATERIAL

[75] Inventor: Philip G. Morton, Germantown, Ohio

[73] Assignee: Aluminum Company of America, Pittsburgh, Pa.

[21] Appl. No.: 345,666

[22] Filed: May 1, 1989

[51] Int. Cl.[5] ..... E04C 2/38

[52] U.S. Cl. ..... 52/656; 52/209

[58] Field of Search ..... 49/501, 504; 52/656, 52/207, 209; 160/90, 92

[56] References Cited

U.S. PATENT DOCUMENTS

| | | | |
|---|---|---|---|
| 2,705,415 | 4/1955 | Livesay | 52/204 |
| 3,184,801 | 5/1965 | Fletcher | 52/209 |
| 3,269,452 | 8/1966 | Pirozzi | 160/90 |
| 4,259,813 | 4/1981 | Winner et al. . | |
| 4,428,156 | 8/1984 | Malm et al. . | |
| 4,555,868 | 12/1985 | Mancuso . | |
| 4,580,366 | 2/1986 | Hardy . | |

*Primary Examiner*—Michael Safavi

*Attorney, Agent, or Firm*—Jacox & Meckstroth

[57] ABSTRACT

A rectangular window frame includes vertical jamb members rigidly connected by a head member and a sill member all formed from extrusions of rigid plastics material or vinyl. The jamb members include outer portions integrally connected to inner portions and the outer portions of the jamb members have welded mitered corner joints with the sill member and the head member. The inner portions of the jamb members have right angle end surfaces which abut the head and sill members to cover internal flash at the corner joints. The sill member has a sloping top wall which welds to internal walls of the jamb members, and the jamb and head members have inwardly projecting flanges which engage one side of an insulated glass unit retained by extruded glazing beads inserted into grooves within the frame members and a cross rail at the middle of the frame. A lower durometer or semi-rigid integral nailing flange projects outwardly from a peripheral recess formed within the frame.

20 Claims, 1 Drawing Sheet

WINDOW ASSEMBLY OF EXTRUDED PLASTICS MATERIAL

BACKGROUND OF THE INVENTION

In the construction of rigid vinyl window assemblies, for example, of the type disclosed in U.S. Pat. Nos. 4,259,813, 4,428,156, 4,555,868, and 4,580,366, the window and sash frames are formed of sections of extruded rigid vinyl or similar plastics material. It has been found desirable to form each of the frames with fusion-welded mitered corner joints in place of mechanical fasteners in order to provide a fluid-tight frame with substantial rigidity and to avoid the possibility of the fasteners becoming loose after period of time or use.

One of the problems encountered with welded mitered corner joints on the window and sash frames, is the creation of flash at the corner joints. The external flash which projects outwardly from the frame corners may be quickly and efficiently removed with the aid of a trimming machine. However, the internal flash requires hand trimming which adds significantly to the time and cost for producing a window frame with welded mitered corner joints. It is also desirable for the sill member of the window frame to have a slope for water drainage but without adding on or attaching another sill section such as disclosed in above mentioned U.S. Pat. No. 4,580,366. The additional sill section not only adds costs to the frame but also increases the overall height of the sill and thereby reduces the height of the viewing area through the glass unit.

It has also been found desirable in new construction for a vinyl window frame to incorporate an integral nailing flange through which nails may be driven without requiring a prepunched or drilled hole. Furthermore, when the window assembly is combined with another window assembly, it is frequently desirable to remove the opposing nailing flanges so that the window assemblies may be installed in closely spaced relation. One form of integrally formed or extruded nailing flange is disclosed in above mentioned U.S. Pat. No. 4,259,813.

SUMMARY OF THE INVENTION

The present invention is directed to an improved rectangular window assembly which may be of the vertical or horizontal sliding type and which incorporates sections of extruded rigid plastics or vinyl material assembled together to provide all of the desirable features mentioned above. In accordance with one embodiment of the invention, a window assembly incorporates a rectangular frame formed by a pair of elongated vertical jamb members connected by a horizontal head member and a horizontal sill member. Each of the members is formed from an extrusion of rigid vinyl with each jamb member including an outer portion integrally connected to an inner portion projecting inwardly into the frame from the outer portion. The outer portions of the jamb members have welded mitered corner joints with the sill member and the head member, and the inner portions of the jamb members have right angled end surfaces abutting the horizontal head member and sill member for covering internal flash at the welded mitered corner joints.

The sill member includes a sloping top wall and a rib which are welded to inner walls of the jamb members at the bottom mitered corner joints. The window frame members also incorporate outwardly projecting an integrally extruded semi-rigid nailing flanges which have a durometer substantially lower than the durometer of the frame members so that nails may be driven through the nailing flanges without splitting the flanges. The nailing flanges project outwardly from slight recesses formed within the outer walls of the frame members to provide for conveniently removing any portion of the nailing flanges and obtaining a flush outer surface without further trimming.

Other features and advantages of the invention will be apparent from the following description, the accompanying drawings and the appended claims.

DESCRIPTION OF THE PREFERRED EMBODIMENT

Figure 1:
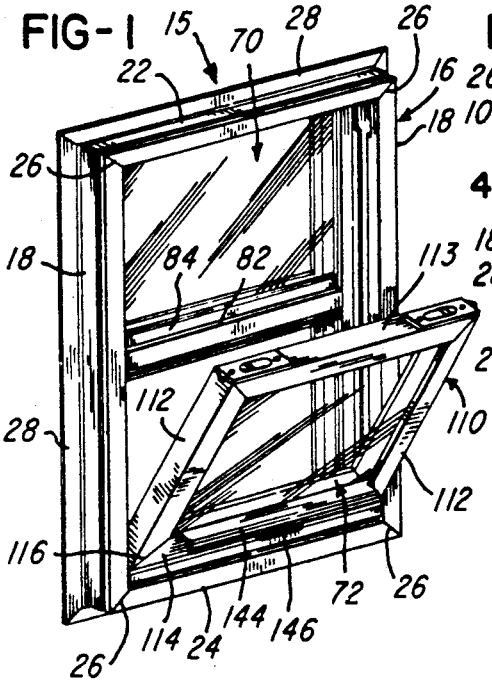
FIG. 1 is a perspective view of a single hung window assembly constructed in accordance with the invention.

The window assembly 15 illustrated in FIG. 1 includes a rigid window frame 16 formed by a pair of rigid plastic or vinyl jamb members 18 connected by a rigid vinyl head member 22 and a rigid vinyl sill member 24. The elongated frame members 18, 22 and 24 are tubular or hollow and are rigidly connected by fusion-welded mitered corner Joints 26. Each of the frame members 18, 22 and 24 is extruded from a vinyl material having a durometer preferably between 105 and 110, and each of the frame members also includes an outwardly projecting integral nailing flange 28 which is extruded with a lower durometer, preferably between 80–95. This lower durometer permits nails to be driven through the flange without requiring prepunched or drilled holes within the flange. The integral nailing flange 28 on each frame member connects to the frame member within a longitudinally extending groove or recess 31 which permits convenient removal of the flange, as will be explained later.

Figure 4:
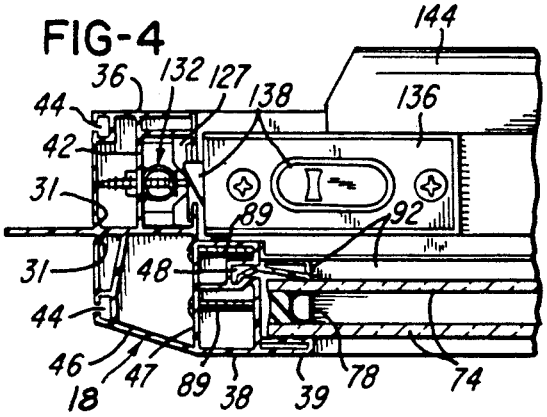
FIG. 4 is a fragmentary horizontal section taken generally on the line 4—4 of FIG. 2.

Referring to FIG. 4, each of the hollow jamb members 18 includes an outer portion 36 and an integrally extruded inner portion 38 which has an inwardly projecting hollow flange 39. The outer portion 36 defines a channel 42 and a pair of undercut grooves 44 for receiving trim accessories (not shown), and has an angled exterior surface 46. An inner wall 47 joins the outer portion 36 to the inner portion 38, and the inner portion 38 also has a longitudinally extending undercut groove 48.

Figure 3:
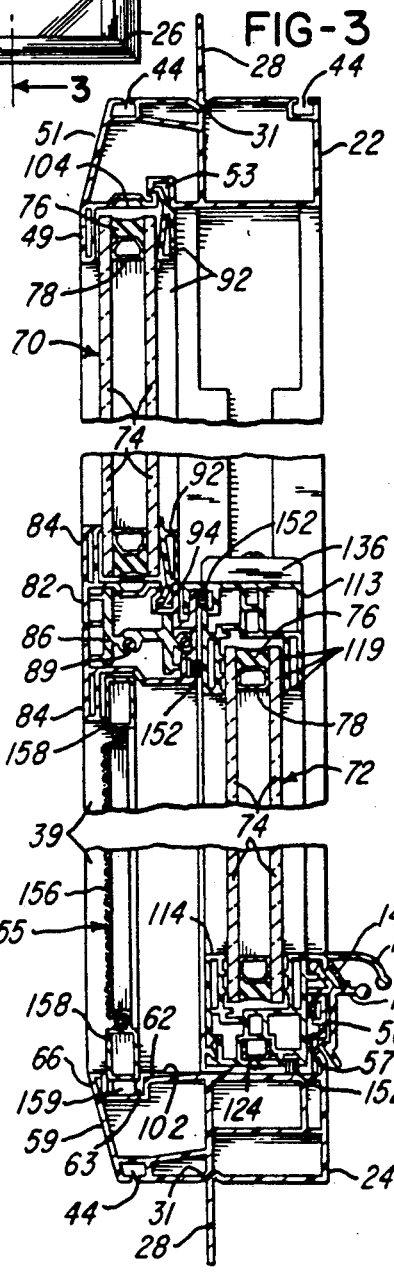
FIG. 3 is a vertical section taken generally on the line 3—3 of FIG. 2.

As shown in FIG. 3, the tubular head member 22 also incorporates a pair of undercut grooves 44 for receiving trim accessories, an inwardly projecting hollow flange 49 and an angled exterior surface 51. The head member 22 also has an inverted U-shaped wall portion which defines a longitudinally extending undercut groove 53. As also shown in FIG. 3, the sill member 24 includes an upwardly or inwardly projecting flange 56 with a latch recess 57, a downwardly facing groove 44 for receiving trim accessories and an angled exterior surface 59. In addition, the sill member has a slightly inclined or sloping top wall 62 which extends to a channel 63 partially defined by an upwardly or inwardly projecting rib portion 66.

The window frame 16 encloses a stationary insulated glass unit 70 and a movable or vertically sliding insulated glass unit 72. Each of the units 70 and 72 includes a pair of rectangular glass panels or lites 74 bonded together by a peripheral rubber-like adhesive strip 76 and separated by a rigid rectangular spacer frame 78. The stationary insulated glass unit 70 extends between the jamb members 18 and from the head member 22 to a cross or meeting rail 82 which is also extruded of a rigid plastics or vinyl material. The rail 82 has upwardly and downwardly projecting hollow flanges 84 and is reinforced by an extruded aluminum insert cross rail or member 86 having opposite end portions secured to the inner portions 38 of the jamb members 18 by a set of screws 89 (FIG. 4). The stationary glass unit 70 is retained against the adjacent flanges 39, 49 and 84 by extruded rigid vinyl glazing beads or strips 92 which snap fit into the grooves 48 and 53 and into a corresponding undercut groove 94 (FIG. 3) formed within the meeting rail 82.

Figure 2:
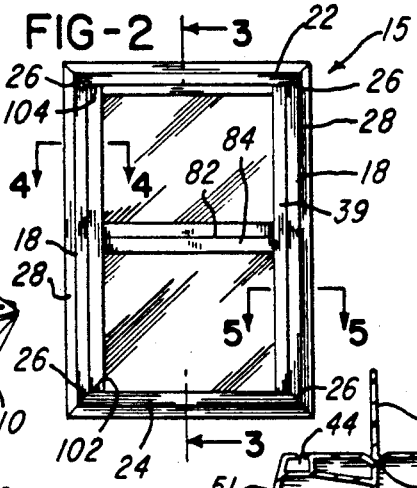
FIG. 2 is an elevational view of the outside of the window assembly shown in FIG. 1.

As shown in FIG. 2, the outer portions 36 of the jamb members 18 have fusion-welded mitered corner Joints 26 with the head member 22 and sill member 24. The inner portions 38 of the jamb members 18 are cut with right angle lower end surfaces 102 which abut the top surfaces of the wall 62 and rib 66 of the sill member 24. Similarly, the jamb portions 38 have right angle upper end surfaces 104 which abut the bottom surface of the head member 22. The flange 49 has right angle end surfaces which abut the flanges 39 on the jamb members 18. As a result, the inner portions 38 of the jamb members 18 are effective to cover and hide the internal flash which is produced during the welding operation of the mitered corner joints 26.

Figure 5:
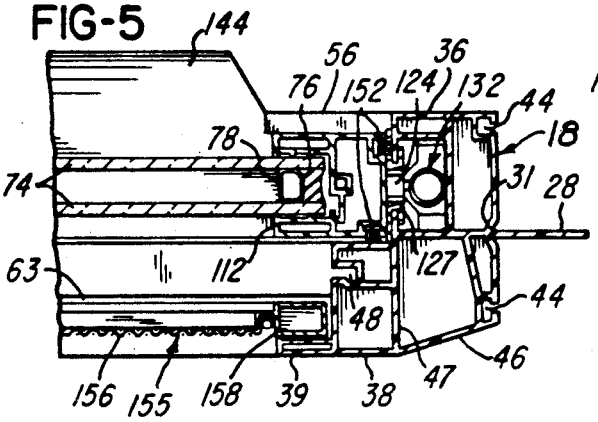
FIG. 5 is a fragmentary horizontal section taken generally on the line 5—5 of FIG. 2.

Referring to FIGS. 3-5, the vertically movable or sliding window unit 72 includes a sash frame 110 formed of extruded sections 112, 113 and 114 of rigid vinyl, and the sections have mitered corner joints 116 which are fusion-welded or joined with mechanical fastening means. When the extruded vinyl sections 112-114 are welded together around the assemble glass panels 74, the window unit 72 has substantial rigidity, and integrally extruded fins 119 provide a weather-tight seal between the sash frame and the glass panels.

As shown in FIG. 1, the movable window unit 72 may be pivoted inwardly to simplify cleaning of the glass panels 74. A set of pivot members or channels 124 (FIG. 3) project outwardly from opposite ends of the base section 114 of the sash frame 110 and connect with pivot shoes 127 (FIG. 5) supported for vertically sliding movement within the channels 42 of the jamb members 18. The pivot shoes 127 connect with a counterbalance mechanism 132 of the known type which incorporates a torsion spring confined within a tube and having a depending helical rotatable support rod connected to the corresponding pivot shoe 127.

Referring to FIG. 4, a set of tilt latches 136 are mounted on the top section 113 of the sash frame 110 and include slidable spring-biased latch elements 138 which project outwardly into the channels 42 for retaining the window unit 72 in a vertical position within the frame 16. When the latch elements 136 are retracted inwardly, the window unit 72 may be tilted as shown in FIG. 1, and the rotation of the pivot channels 124 is effective to expand the shoes 127 so that they clamp the jamb members 18 and prevent sliding of the shoes while the window unit 72 is tilted.

A lift handle 144 (FIG. 3) is extruded as an integral part of the bottom section 114 of the sash frame 110, and the center portion of the handle 144 retains a pivotal latch element 146 formed from an extrusion of rigid vinyl. An expansion spring 148 normally urges the latch element 146 into the latch recess 57 and into hooking engagement with the flange 56 of the sill member 24. As shown in FIGS. 3 and 5, the sections 112–114 of the sash frame 110 are extruded with undercut channels or grooves for receiving weather stripping 152 which contacts the jamb members 36, sill member 24 and the meeting rail 82 to form a weather-tight seal when the window unit 72 is in its downward closed position, a shown in FIG. 3. A rectangular screen unit 155 (FIGS. 3 & 5) includes a screen mesh 156 within a frame 158 which seats in the channel 63 on resilient springs 159 and engages the flanges 39 and 84.

From the drawing of the above description, it is apparent that a window assembly constructed in accordance with the present invention, provides desirable features and advantages. As mentioned above, the construction of the frame 16 with the welded mitered corner joints 26 and the square end surfaces 102 and 104 on the jamb members 18, eliminates the need for hand cleaning or trimming of the internal flash from the joints 26 since the flash is covered by the jamb portions 38. As a result, the time required for producing the frame 16 is significantly reduced. In addition, the cross-section of the jamb members 18 and the cross-section of the sill member 24 provides for fusion-welding of the sloping sill wall 62 to the internal walls 47 of the jamb members 18 at the bottom corner joints 26 to provide the frame 16 with maximum strength and rigidity. As another feature, the semi-rigid nailing flange 28 provides for attachment of the window assembly 15 with nails driven through the flange 28 without requiring prepunched or drilled holes. The recess 31 at the base of each nailing flange 28 also provides for conveniently trimming and removing the nailing flange by scoring the flange with a sharp knife drawn along the recess 31 so that no remaining portion of the severed nailing flange projects outwardly from the outer surface of the corresponding frame member. The angular exterior surfaces 46, 51 and 59 also provide the window assembly with a pleasing appearance.

While the window assembly herein described constitutes a preferred embodiment of the invention, it is to be understood that the invention is not limited to this precise assembly, and that changes may be made therein without departing from the scope and spirit of the invention as defined in the appended claims.

The invention having thus been described, the following is claimed:

1. A window assembly adapted for use in a vertical wall of a building, comprising a generally rectangular frame supporting a generally rectangular light transmitting window unit, said frame including a pair of elongated vertical jamb members connected by a horizontal head member and a horizontal sill member, each of said members being formed from an extrusion of rigid plastics material, each of said jamb members including an outer portion integrally connected to an inner portion projecting inwardly into the frame from said outer portion, said outer portions of said jamb members having welded mitered corner joints with said sill member and said head member, and said inner portions of said jamb members having substantially right angle end surfaces abutting said horizontal head member and sill member for covering internal flash of said welded mitered corner joints.

2. A window assembly as defined in claim 1 wherein said inner portions of said jamb members are hollow and include flange portions projecting inwardly of said frame, and a generally rectangular screen unit engaging said flange portions.

3. A window assembly as defined in claim 1 wherein said head member and said jamb members have flange portions projecting inwardly of said frame, means forming a weather-tight seal between said flange portions and a peripheral portion of said window unit, said head member and said jamb members having corresponding integral wall portions defining grooves extending parallel to the corresponding said flange portions, and elongated glazing members projecting into said grooves and cooperating with said flange portions to confine said peripheral portion of said window unit.

4. A window assembly as defined in claim 1 wherein said sill member includes a top wall sloping downwardly at a slight angle, and said jamb members include inner walls welded to said top wall of said sill member at the lower said mitered corner joints.

5. A window assembly as defined in claim 1 wherein at least said jamb members include outwardly proJecting and integrally extruded co-planar nailing flanges, and said nailing flanges have a lower durometer than the durometer of said plastics material forming said jamb members to provide for driving nails through said nailing flanges without splitting said flanges.

6. A window assembly as defined in claim 5 wherein said jamb members have generally flat outer walls defining longitudinally extending recesses, and said nailing flanges connect with said jamb members within said recesses to facilitate trimming at least one of said nailing flanges from the corresponding said jamb member.

7. A window assembly as defined in claim 1 wherein said sill member includes a sloping top wall defining a groove extending between said jamb members, a generally rectangular screen unit seated within said groove, and said end surfaces of said inner portions of said jamb members cover the end portions of said groove.

8. A window assembly as defined in claim 1 wherein said jamb members and said sill and head members have corresponding outer walls facing outwardly of the building, and said outer walls are inclined relative to the plane of said frame to form a frusto-pyramidal exterior surface on said frame.

9. A window assembly adapted for use in a vertical wall of a building, comprising a generally rectangular frame supporting a generally rectangular light transmitting window unit, said frame including a pair of elongated vertical jamb members connected by a horizontal head member and a horizontal sill member, each of said members being formed from an extrusion of rigid plastics material, each of said jamb members including an outer portion connected to an inner portion projecting inwardly into the frame from said outer portion, said sill member including a downwardly sloping top wall, said outer portions of said jamb members having welded mitered corner joints with said sill member and said head member, said jamb members each having an internal wall between said inner and outer portions and welded to said top wall of said sill member, and said inner portions of said jamb members having generally right angle end surfaces abutting said sill member.

10. A window assembly as defined in claim 21, wherein at least said jamb members include outwardly projecting and integrally extruded co-planar nailing flanges, and said nailing flanges have a lower durometer than the durometer of said plastics material forming said jamb members to provide for driving nails through said nailing flanges without splitting said flanges.

11. A window assembly as defined in claim 21, wherein said jamb members have generally flat outer walls defining longitudinally extending recesses, and integrally extruded co-planar nailing flanges project outwardly from said recesses to facilitate trimming at least one of said nailing flanges from the corresponding said jamb member.

12. A window assembly as defined in claim 21, wherein said sloping top wall defines a groove extending between said jamb members, a generally rectangular screen unit seated within said groove, and said right angle end surfaces cover the end portions of said groove.

13. A window assembly adapted for use in a vertical wall of a building, comprising a generally rectangular frame supporting a generally rectangular light transmitting window unit, said frame including a pair of elongated vertical jamb members connected by a horizontal head member and a horizontal sill member, each of said members being formed from an extrusion of rigid plastics material, at least said jamb members including outwardly projecting and integrally extruded co-planar nailing flanges, and said nailing flanges have a lower durometer than the durometer of said plastics material forming said jamb members to provide for driving nails through said nailing flanges without splitting said flanges.

14. A window assembly as defined in claim 13 wherein said jamb members have generally flat outer walls defining longitudinally extending recesses, and said nailing flanges connect with said jamb members within said recesses to facilitate trimming at least one of said nailing flanges from the corresponding said jamb member.

15. A window assembly adapted for use in a vertical wall of a building, comprising a generally rectangular frame supporting a generally rectangular light transmitting window unit, said frame including a pair of elongated vertical jamb members connected by horizontal head member and a horizontal sill member, each of said members being formed from an extrusion of rigid plastics material, each of said jamb members including an outer portion integrally connected to an inner portion projecting inwardly into the frame from said outer portion, said outer portions of said jamb members having mitered corner joints with said sill member and said head member, means for rigidly connecting said members at said corner joints, and said inner portions of said jamb members having substantially right angle end surfaces abutting at least said horizontal sill member.

16. A window assembly as defined in claim 15 wherein said inner portions of said jamb members are hollow and include flange portions projecting inwardly of said frame, and a generally rectangular screen unit engaging said flange portions.

17. A window assembly as defined in claim 15 wherein said head member and said jamb members have flange portions projecting inwardly of said frame, means forming a weather-tight seal between said flange portions and a peripheral portion of said window unit, said head member and said jamb members having corresponding integral wall portions defining grooves extending parallel to the corresponding said flange portions, and elongated glazing members projecting into said grooves and cooperating with said flange portions to confine said peripheral portion of said window unit.

18. A window assembly as defined in claim 15 wherein said sill member includes a top wall sloping downwardly at a slight angle, and said jamb members include inner walls mating with said top wall of said sill member at the lower said mitered corner joints.

19. A window assembly as defined in claim 15 wherein at least said jamb members include outwardly projecting and integrally extruded co-planar nailing flanges, and said nailing flanges have a lower durometer than the durometer of said plastics material forming said jamb members to provide for driving nails through said nailing flanges without splitting said flanges.

20. A window assembly as defined in claim 15 wherein said sill member includes a sloping top wall defining a groove extending between said jamb members, a generally rectangular screen unit seated within said groove, and said end surfaces of said inner portions of said jamb members cover the end portions of said groove.

* * * * *

UNITED STATES PATENT AND TRADEMARK OFFICE

CERTIFICATE OF CORRECTION

PATENT NO. : 5,003,747

DATED : April 2, 1991

INVENTOR(S) : Philip G. Morton

It is certified that error appears in the above-identified patent and that said Letters Patent is hereby corrected as shown below:

Column 6:
Claim 10, line 1, cancel "21" and insert --9--

Claim 11, line 1, cancel "21" and insert --9--

Claim 12, line 1, cancel "21" and insert --9--

Signed and Sealed this

Twentieth Day of October, 1992

*Attest:*

DOUGLAS B. COMER

*Attesting Officer*

*Acting Commissioner of Patents and Trademarks*